US010852030B2

(12) United States Patent
Watanabe et al.

(10) Patent No.: US 10,852,030 B2
(45) Date of Patent: Dec. 1, 2020

(54) INDOOR UNIT FOR AIR-CONDITIONING APPARATUS

(71) Applicant: Mitsubishi Electric Corporation, Tokyo (JP)

(72) Inventors: Yuki Watanabe, Tokyo (JP); Masato Ishikawa, Tokyo (JP); Masahide Kinami, Tokyo (JP); Yosuke Naito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 185 days.

(21) Appl. No.: 15/781,744

(22) PCT Filed: Feb. 8, 2016

(86) PCT No.: PCT/JP2016/053639
§ 371 (c)(1),
(2) Date: Jun. 6, 2018

(87) PCT Pub. No.: WO2017/138066
PCT Pub. Date: Aug. 17, 2017

(65) Prior Publication Data

US 2018/0356123 A1 Dec. 13, 2018

(51) Int. Cl.
*F24F 13/20* (2006.01)
*F24F 1/32* (2011.01)
(Continued)

(52) U.S. Cl.
CPC ..... *F24F 13/20* (2013.01); *F24F 1/0007* (2013.01); *F24F 1/0057* (2019.02); *F24F 1/02* (2013.01); *F24F 1/32* (2013.01)

(58) Field of Classification Search
CPC ..... F24F 13/20; F24F 1/0057; F24F 1/0007; F24F 1/02; F24F 1/32; F24F 2203/1012
See application file for complete search history.

(56) References Cited

U.S. PATENT DOCUMENTS 7,757,510 B2 * 7/2010 Rosete ..... F24F 3/0442 312/257.1
2016/0033161 A1 2/2016 Koyanagi et al.

FOREIGN PATENT DOCUMENTS

JP S58-117031 U1 8/1983
JP H05-126357 A 5/1993
(Continued)

OTHER PUBLICATIONS

International Search Report of the International Searching Authority dated May 10, 2016 for the corresponding International application No. PCT/JP2016/053639 (and English translation).
(Continued)

*Primary Examiner* — Joseph F Trpisovsky
(74) *Attorney, Agent, or Firm* — Posz Law Group, PLC

(57) ABSTRACT

An indoor unit for an air-conditioning apparatus includes a casing forming an outer frame. The casing includes a lower right-side panel, a right bottom panel, a lower left-side panel, and a left bottom panel. The lower right-side panel, the right bottom panel, the lower left-side panel, and the left bottom panel each include a panel provided with a void through which pipes are drawn out and a panel without the void. The lower right-side panel, the right bottom panel, the lower left-side panel, and the left bottom panel with or without the void are selectively attached to the indoor unit.

2 Claims, 6 Drawing Sheets

(51) Int. Cl.

| | |
|---|---|
| ***F24F 1/0057*** | (2019.01) |
| ***F24F 1/0007*** | (2019.01) |
| ***F24F 1/02*** | (2019.01) |

(56) References Cited

FOREIGN PATENT DOCUMENTS

| | | | |
|---|---|---|---|
| JP | 2002-054821 | A | 2/2002 |
| JP | 2002-349894 | A | 12/2002 |
| JP | 2011-149649 | A | 8/2011 |

OTHER PUBLICATIONS

Office Action dated Jun. 3, 2019 issued in corresponding CN patent application No. 201680003297.4 (and English translation).
Extended European Search Report dated Jan. 21, 2019 issued in corresponding EP patent application No. 16889768.4.

* cited by examiner

INDOOR UNIT FOR AIR-CONDITIONING APPARATUS

CROSS REFERENCE TO RELATED APPLICATION

This application is a U.S. national stage application of PCT/JP2016/053639 filed on Feb. 8, 2016, the contents of which are incorporated herein by reference.

TECHNICAL FIELD

The present invention relates to indoor units for air-conditioning apparatuses including a lower right-side panel, a right bottom panel, a lower left-side panel, and a left bottom panel.

BACKGROUND ART

Indoor units having notched plates for drawing out pipes formed on casings thereof have been well known (for example, see Patent Literature 1). In a conventional indoor unit described in Patent Literature 1, pipes are drawn out from the unit through points where notched plates are cut off.

CITATION LIST

Patent Literature

Patent Literature 1: Japanese Unexamined Patent Application Publication No. 2002-54821

SUMMARY OF INVENTION

Technical Problem

However, the conventional indoor unit as described in Patent Literature 1 has groove-shaped notched lines, used for cutting off the notched plates, formed in the design surfaces thereof at a plurality of points, resulting in a problem regarding design.

The present invention is produced to solve the above-described problem, and an object of the present invention is to provide an indoor unit for an air-conditioning apparatus with improved design.

Solution to Problem

An indoor unit for an air-conditioning apparatus according to one embodiment of the present invention is an indoor unit for an air-conditioning apparatus, the indoor unit being connected to an outdoor unit using a pipe, the indoor unit comprising: a casing constituting an outer frame, the casing including a lower right-side panel constituting a part of a lower portion of a right side of the casing, a right bottom panel constituting a part of a right portion of a bottom of the casing, a lower left-side panel constituting a part of a lower portion of a left side of the casing, and a left bottom panel constituting a part of a left portion of the bottom of the casing, any of the lower right-side panel, the right bottom panel, the lower left-side panel, and the left bottom panel being a panel provided with a void through which the pipe is drawn out or a panel without the void, wherein the lower right-side panel, the right bottom panel, the lower left-side panel, and the left bottom panel, constituting the casing, are those with or without the void, selectively.

According to the present invention, an indoor unit for an air-conditioning apparatus with improved design can be obtained since the panels with the void and those without the void can constitute the casing of the indoor unit depending on the position of the pipes to be drawn out.

DESCRIPTION OF EMBODIMENT

Figure 1:
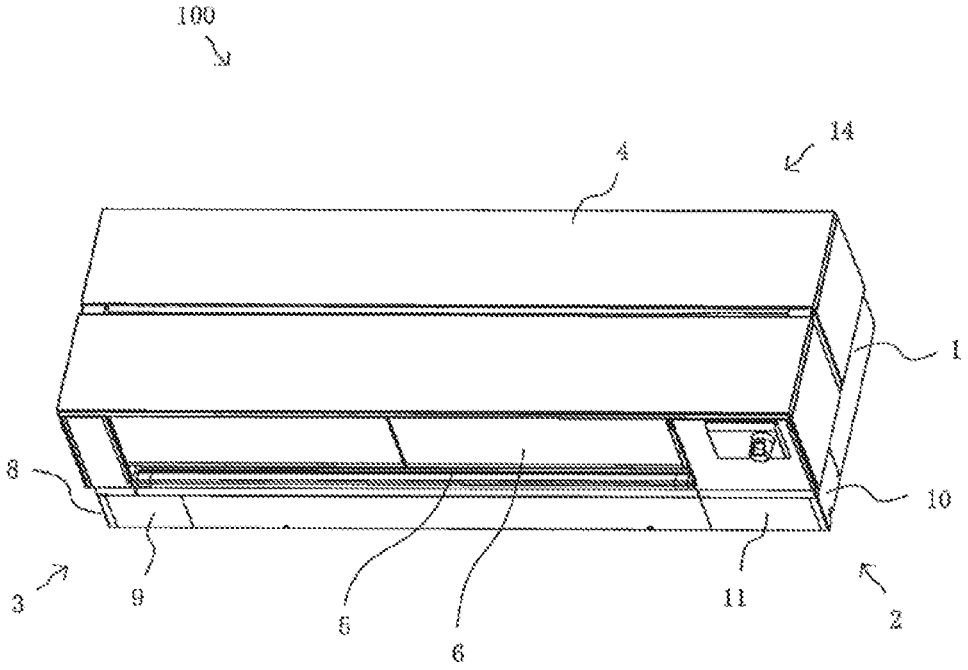
FIG. 1 is a perspective view illustrating an indoor unit for an air-conditioning apparatus according to Embodiment 1 of the present invention.

An embodiment of the present invention will be described thereinafter with reference to the drawings. In the drawings, the same reference numerals are used for the same or corresponding components, and the descriptions thereof will be omitted or simplified. Moreover, various modifications in, for example, the shapes, sizes, and layouts of the structures illustrated in the drawings are possible within the scope of the present invention.

Embodiment 1

[Indoor Unit for Air-Conditioning Apparatus]

FIG. 1 is a perspective view illustrating an indoor unit for an air-conditioning apparatus according to Embodiment 1 of the present invention. An indoor unit 100 illustrated in FIG. 1 is connected to an outdoor unit (not illustrated) using a refrigerant pipe to condition the air inside a room. The indoor nit 100 is, for example, installed on a wall of the room. The indoor unit 100 has a casing 14 forming the outer frame of the indoor unit 100. The casing 14 includes, for example, a rear case 1 and a front case 4, and has substantially a rectangular parallelepiped shape. The casing 14 accommodates, for example, a heat exchanger (not illustrated), a ventilation fan, an electric component box, and other components. The front case 4 is attached to the rear case 1. The front case 4 has an air outlet 5 formed therein, and a wind adjusting unit 6 adjusting the direction of wind is disposed in the air outlet 5. The indoor unit 100 takes in the air inside the room by, for example, the operation of the ventilation fan. The heat of the taken air is exchanged at the heat exchanger, and the resulting conditioned air is blown out from the air outlet 5 into the room.

Moreover, the casing 14 includes a lower right-side panel 10, a right bottom panel 11, a lower left-side panel 8, and a left bottom panel 9. Each of the lower right-side panel 10, the right bottom panel 11, the lower left-side panel 8, and the left bottom panel 9 is attached to, for example, the rear case 1. However, each of them may be attached to the front case 4.

The lower right-side panel 10 forms a part of a lower portion of the right side of the casing 14. The right bottom panel 11 forms a part of a right portion of the bottom of the casing 14. The lower right-side panel 10 and the right bottom panel 11 constitute a part of a lower right corner portion 2 including, for example, the right side and the bottom of the casing 14 adjacent to the rear side.

The lower left-side panel 8 forms a part of a lower portion of the left side of the casing 14. The left bottom panel 9 forms a part of a left portion of the bottom of the casing 14. The lower left-side panel 8 and the left bottom panel 9 constitute a part of a lower left corner portion 3 including, for example, the left side and the bottom of the casing 14 adjacent to the rear side.

The lower right-side panel 10, the right bottom panel 11, the lower left-side panel 8, and the left bottom panel 9 each include a panel provided with a void for drawing out pipes and a panel without the void as described below. The lower right-side panel 10, the right bottom panel 11, the lower left-side panel 8, and the left bottom panel 9 with or without the void are selected depending on the position of the pipes to be drawn out, and attached to the indoor unit 100.

[Combination of Lower Right-Side Panel and Right Bottom Panel]

Figure 2:
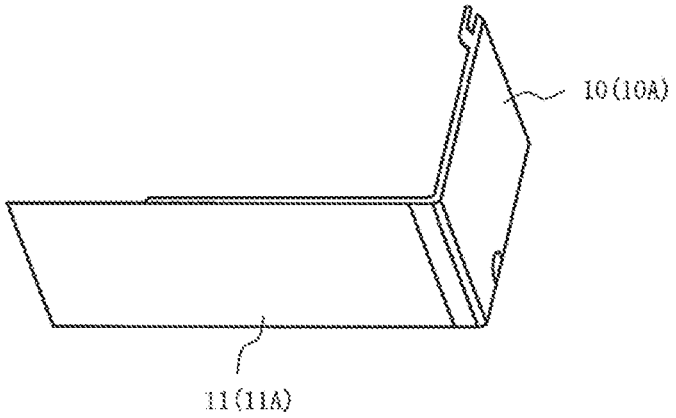
FIG. 2 illustrates an example combination of a lower right-side panel and a right bottom panel illustrated in FIG. 1.
Figure 3:
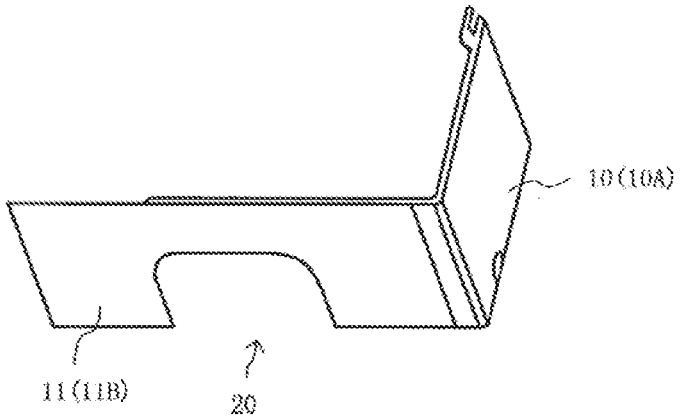
FIG. 3 illustrates another example combination of the lower right-side panel and the right bottom panel illustrated in FIG. 1.
Figure 4:
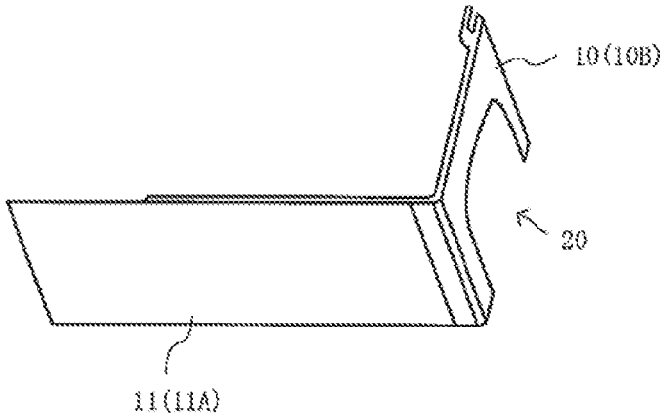
FIG. 4 illustrates yet another example combination of the lower right-side panel and the right bottom panel illustrated in FIG. 1.

FIG. 2 illustrates an example combination of the lower right-side panel and the right bottom panel illustrated in FIG. 1. FIG. 3 illustrates another example combination of the lower right-side panel and the right bottom panel illustrated in FIG. 1. FIG. 4 illustrates yet another example combination of the lower right-side panel and the right bottom panel illustrated in FIG. 1.

As illustrated in FIGS. 2 to 4, the lower right-side panel 10 includes a first lower right-side panel 10A without a void and a second lower right-side panel 10B having a void 20 formed therein. Moreover, the right bottom panel 11 includes a first right bottom panel 11A without a void and a second right bottom panel 11B having the void 20 formed therein. Each of the first lower right-side panel 10A and the second lower right-side panel 10B may be assembled to either the first right bottom panel 11A or the second right bottom panel 11B. For example, an assembly of the lower right-side panel 10 and the right bottom panel 11 is attached to the indoor unit 100.

For example, as illustrated in FIG. 1, when the pipes are not drawn out from the lower right corner portion 2, the combination of the first lower right-side panel 10A and the first right bottom panel 11A as illustrated in FIG. 2 is selected, and the first lower right-side panel 10A and the first right bottom panel 11A are attached to the indoor unit 100.

When the pipes are drawn out from the bottom of the lower right corner portion 2, the combination of the first lower right-side panel 10A and the second right bottom panel 11B as illustrated in FIG. 3 is selected, and the first lower right-side panel 10A and the second right bottom panel 11B are attached to the indoor unit 100. The pipes are then drawn out through the void 20 of the second right bottom panel 11B.

When the pipes are drawn out from the right side of the lower right corner portion 2, the combination of the second lower right-side panel 10B and the first right bottom panel 11A as illustrated in FIG. 4 is selected, and the second lower right-side panel 10B and the first right bottom panel 11A are attached to the indoor unit 100. The pipes are then drawn out through the void 20 of the second lower right-side panel 10B.

[Combination of Lower Left-Side Panel and Left Bottom Panel]

Figure 5:
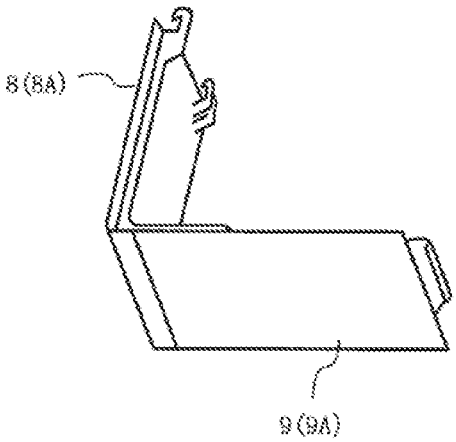
FIG. 5 illustrates an example combination of a lower left-side panel and a left bottom panel illustrated in FIG. 1.
Figure 6:
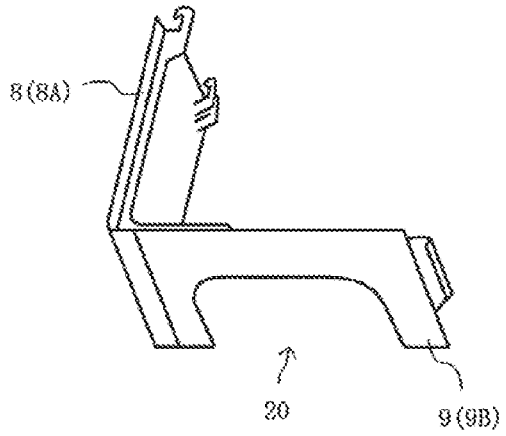
FIG. 6 illustrates another example combination of the lower left-side panel and the left bottom panel illustrated in FIG. 1.
Figure 7:
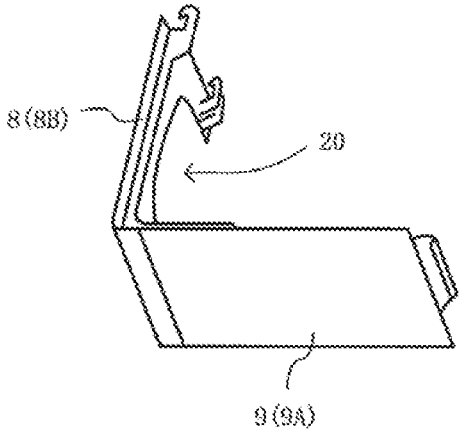
FIG. 7 illustrates yet another example combination of the lower left-side panel and the left bottom panel illustrated in FIG. 1.

FIG. 5 illustrates an example combination of the lower left-side panel and the left bottom panel illustrated in FIG. 1. FIG. 6 illustrates another example combination of the lower left-side panel and the left bottom panel illustrated in FIG. 1. FIG. 7 illustrates yet another example combination of the lower left-side panel and the left bottom panel illustrated in FIG. 1.

As illustrated in FIGS. 5 to 7, the lower left-side panel 8 includes a first lower left-side panel 8A without a void and a second lower left-side panel 8B having the void 20 formed therein. Moreover, the left bottom panel 9 includes a first left bottom panel 9A without a void and a second left bottom panel 9B having the void 20 formed therein. Each of the first lower left-side panel 8A and the second lower left-side panel 8B may be assembled to either the first left bottom panel 9A or the second left bottom panel 9B. For example, an assembly of the lower left-side panel 8 and the left bottom panel 9 is attached to the indoor unit 100.

For example, as illustrated in FIG. 1, when the pipes are not drawn out from the lower left corner portion 3, the combination of the first lower left-side panel 8A and the first left bottom panel 9A as illustrated in FIG. 5 is selected, and the first lower left-side panel 8A and the first left bottom panel 9A are attached to the indoor unit 100.

When the pipes are drawn out from the bottom of the lower left corner portion 3, the combination of the first lower left-side panel 8A and the second left bottom panel 9B as illustrated in FIG. 6 is selected, and the first lower left-side panel 8A and the second left bottom panel 9B are attached to the indoor unit 100. The pipes are then drawn out through the void 20 of the second left bottom panel 9B.

When the pipes are drawn out from the left side of the lower left corner portion 3, the combination of the second lower left-side panel 8B and the first left bottom panel 9A as illustrated in FIG. 7 is selected, and the second lower left-side panel 8B and the first left bottom panel 9A are attached to the indoor unit 100. The pipes are then drawn out through the void 20 of the second lower left-side panel 8B.

Comparative Example 1

Figure 8:
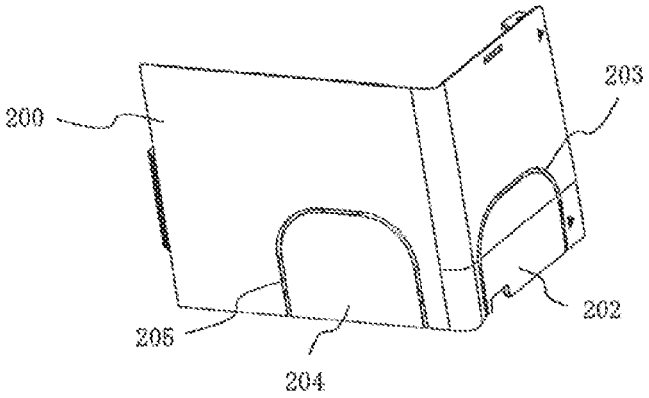
FIG. 8 illustrates Comparative Example 1 of Embodiment 1.

FIG. 8 illustrates Comparative Example 1 of Embodiment 1. An L-shaped cover 200 of Comparative Example 1 illustrated in FIG. 8 is to be attached to a corner portion of an air-conditioning apparatus. The L-shaped cover 200 includes a first notched plate 202 and a second notched plate 204. In Comparative Example 1, when pipes are drawn out from a surface having the first notched plate 202, the pipes are drawn through a hole formed by cutting off the first notched plate 202. When the pipes are drawn out from a surface having the second notched plate 204, the pipes are drawn out through a hole formed by cutting off the second notched plate 204. The L-shaped cover 200 of Comparative Example 1 has a groove-shaped first notched line 203 and a groove-shaped second notched line 205 formed thereon, each line used to cut off the first notched plate 202 and the second notched plate 204, respectively. Even though no pipes are drawn out from the surfaces having the first notched line 203 and the second notched line 205 formed thereon, the existence of the notched lines causes a problem regarding design to the indoor unit having the L-shaped cover 200 of Comparative Example 1 attached thereto since the notched lines are formed on the design surfaces of the indoor unit. Furthermore, in Comparative Example 1, there is another problem of the need for a complicated task of forming a hole using a tool such as nippers when the first notched plate 202 or the second notched plate 204 is cut off.

Compared with Comparative Example 1, the indoor unit 100 according to this embodiment includes the lower right-side panel 10 constituting a part of the lower portion of the right side of the casing 14, the right bottom panel 11 constituting a part of the right portion of the bottom of the casing 14, the lower left-side panel 8 constituting a part of the lower portion of the left side of the casing 14, and the left bottom panel 9 constituting a part of the left portion of the bottom of the casing 14; and the lower right-side panel 10, the right bottom panel 11, the lower left-side panel 8, and the left bottom panel 9 each include the panel with the void 20 through which pipes are drawn out and the panel without the void as illustrated in FIGS. 1 to 7. In the indoor unit 100 according to this embodiment, any of the lower right-side panel 10, the right bottom panel 11, the lower left-side panel 8, and the left bottom panel 9 is a panel provided with a void through which the pipe is drawn out or a panel without the void, and a selective combination of the lower right-side panel 10, the right bottom panel 11, the lower left-side panel 8, and the left bottom panel 9, with or without the void, constituting the casing of the indoor unit. Therefore, the indoor unit 100 according to this embodiment does not have unnecessary shapes such as notched lines that may ruin the design at surfaces from which the pipes are not drawn out, resulting in improved design.

Furthermore, in the indoor unit 100 according to this embodiment, the pipes can be drawn out through the void 20 by merely selectively attaching any of the panels with the void 20. This omits complicated tasks of, for example, forming a hole using a tool, resulting in improved work efficiency.

[Lower Right Panel Kit]

Figure 9:
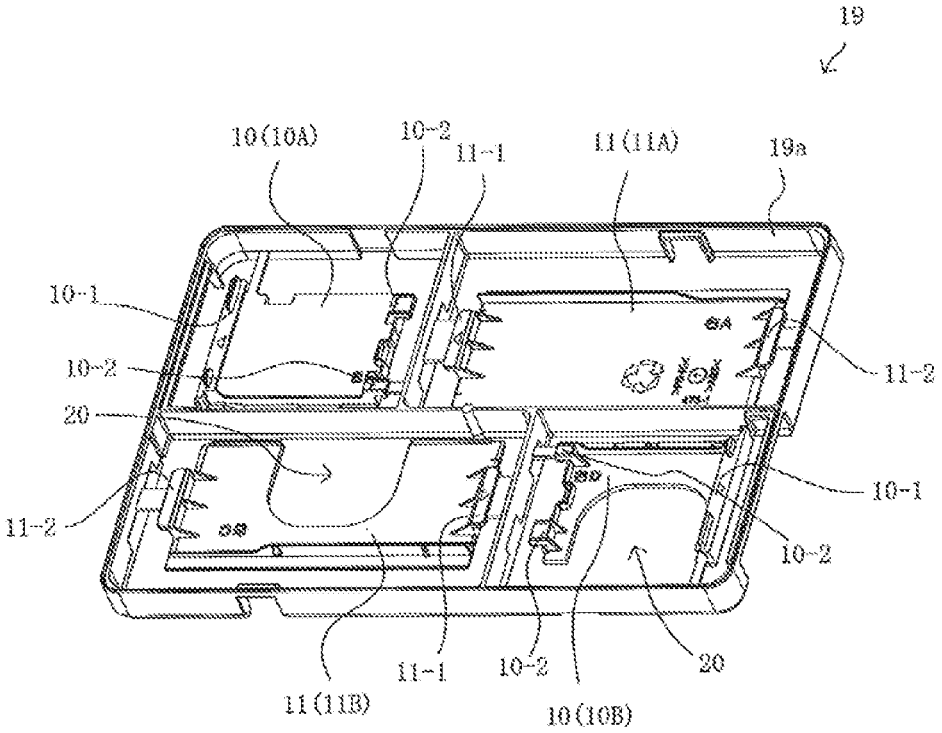
FIG. 9 illustrates a lower right panel kit including a frame to which the lower right-side panel and the right bottom panel are attached.
Figure 10:
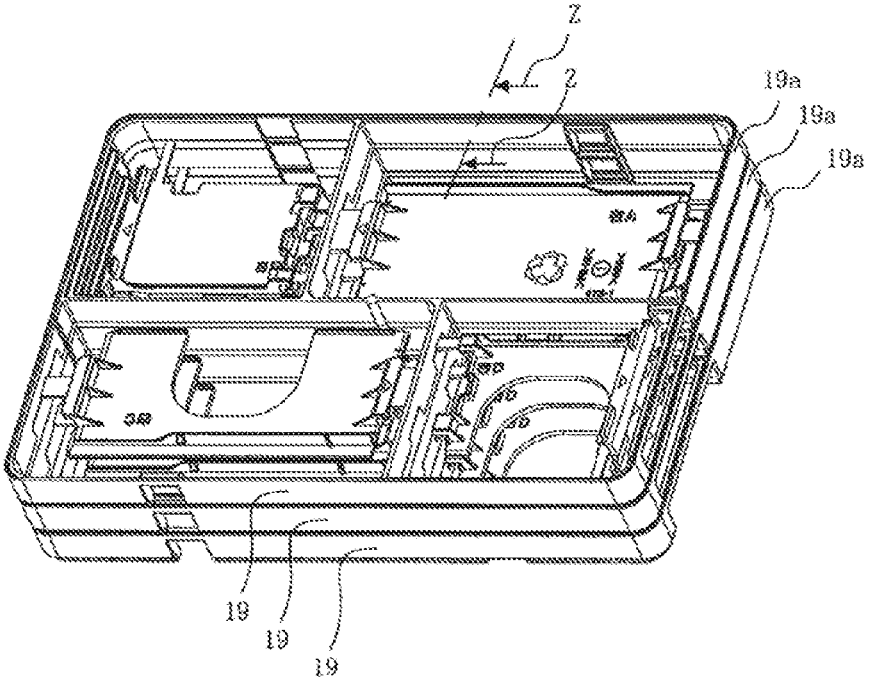
FIG. 10 illustrates the lower right panel kits illustrated in FIG. 9 stacked on top of each other.
Figure 11:
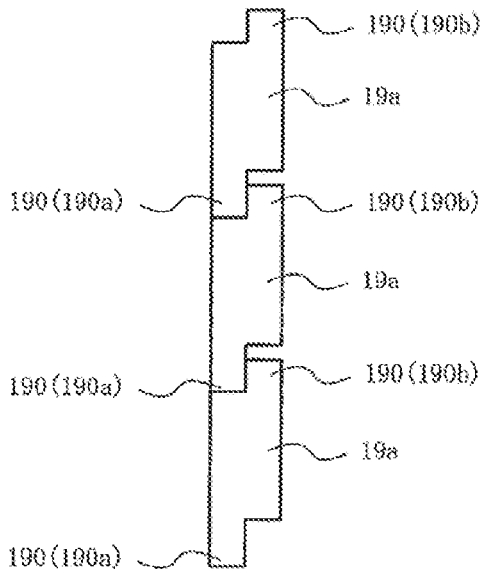
FIG. 11 is a schematic view taken along line Z-Z in FIG. 10.

FIG. 9 illustrates a lower right panel kit including a frame to which the lower right-side panel and the right bottom panel are attached. FIG. 10 illustrates the lower right panel kits illustrated in FIG. 9 stacked on top of each other. FIG. 11 is a schematic view taken along line Z-Z in FIG. 10. In the description below, only a lower right panel kit 19 including a first frame 19*a* to which the lower right-side panel 10 and the right bottom panel 11 are attached will be described. Descriptions of a lower left panel kit, including a second frame to which the lower left-side panel 8 and the left bottom panel 9 are attached, will be omitted since it has substantially the same structure as the lower right panel kit 19.

As illustrated in FIG. 9, the lower right panel kit 19 includes the first frame 19*a* and the first lower right-side panel 10A, the second lower right-side panel 10B, the first right bottom panel 11A, and the second right bottom panel 11B attached to the first frame 19*a*. The lower right panel kit 19 is formed of, for example, a molded article formed by injection molding of resin or other materials. Accordingly, the first lower right-side panel 10A, the second lower right-side panel 10B, the first right bottom panel 11A, and the second right bottom panel 11B can be formed at low cost. The first lower right-side panel 10A, the second lower right-side panel 10B, the first right bottom panel 11A, and the second right bottom panel 11B can easily be cut off from the first frame 19*a* using, for example, nippers or other tools.

The first lower right-side panel 10A and the second lower right-side panel 10B each include an coupler portion 10-1 to be assembled with an coupler portion 11-1 of the first right bottom panel 11A or the second right bottom panel 11B and an attachment portion 10-2 for attaching the panel to the indoor unit 100. The first right bottom panel 11A and the second right bottom panel 11B each include the coupler portion 11-1 to be assembled with the coupler portion 10-1 of the first lower right-side panel 10A or the second lower right-side panel 10B and an attachment portion 11-2 for attaching the panel to the indoor unit 100. The coupler portion 10-1 and the attachment portion 10-2 are common to the first lower right-side panel 10A and the second lower right-side panel 10B, and the coupler portion 11-1 and the attachment portion 11-2 are common to the first right bottom panel 11A and the second right bottom panel 11B, thereby facilitating attachment of the panels to the indoor unit.

For example, the height of the first frame 19*a* is larger than the thickness of the first lower right-side panel 10A, the second lower right-side panel 10B, the first right bottom panel 11A, and the second right bottom panel 11B so that the first frame 19*a* protects the first lower right-side panel 10A, the second lower right-side panel 10B, the first right bottom panel 11A, and the second right bottom panel 11B against rubbing, impact, and the like. This allows omission or simplification of buffers, packing materials, and other materials required to carry and store the first lower right-side panel 10A, the second lower right-side panel 10B, the first right bottom panel 11A, and the second right bottom panel 11B.

As illustrated in FIG. 10, the lower right panel kit 19 is stackable on another kit, and the stack of the lower right panel kits 19 can be carried or stored as it is. Specifically, as illustrated in FIG. 11, the first frame 19*a* includes an engaging portion 190 engaging the first frame 19*a* with another first frame 19*a* when the lower right panel kits 19 are stacked and thus the first frames 19*a* are layered in the height direction thereof. The engaging portion 190 is formed of, for example, a combination of stepped shapes including a first engaging portion 190*a*, hollowed from the outer circumferential surface toward the inner circumferential surface of the first frame 19*a* and protruding in the height direction of the first frame 19*a*, and a second engaging portion 190*b*, hollowed from the inner circumferential surface toward the outer circumferential surface of the first frame 19*a* and protruding in the height direction of the first frame 19*a*. Moreover, the protruding height of the first engaging portion 190*a* is larger than that of the second engaging portion 190*b*. In this embodiment, the lower right panel kits 19 can be stacked while the layered first frames 19*a* are engaged with each other. This allows omission or simplification of buffers, packing materials, and other materials required to carry and store the lower right panel kits 19.

[Assembly of Lower Right-Side Panel and Right Bottom Panel]

Figure 12:
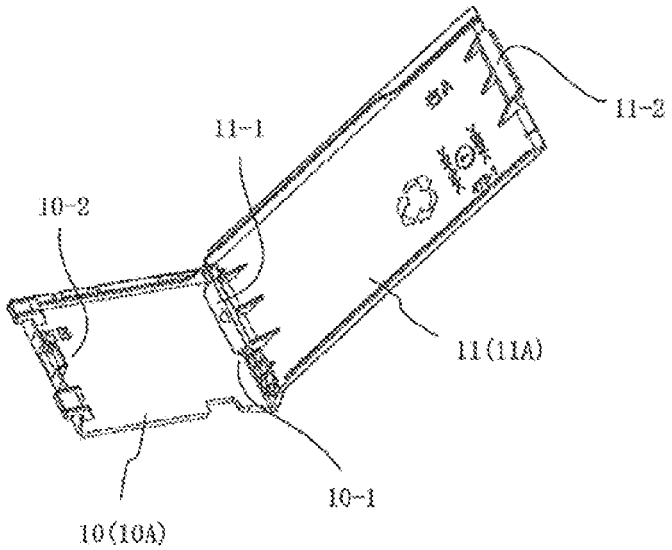
FIG. 12 illustrates an example assembly of the lower right-side panel and the right bottom panel.

FIG. 12 illustrates an example assembly of the lower right-side panel and the right bottom panel. As illustrated in FIG. 12, the lower right-side panel 10 and the right bottom panel 11 are assembled together by relatively rotating the lower right-side panel 10 and the right bottom panel 11 to adjust the angle therebetween while the coupler portion 10-1 and the coupler portion 11-1 are joined together. The assembly of the lower right-side panel 10 and the right bottom panel 11 is then attached to the indoor unit 100.

[Packing of Indoor Unit for Transportation]

Figure 13:
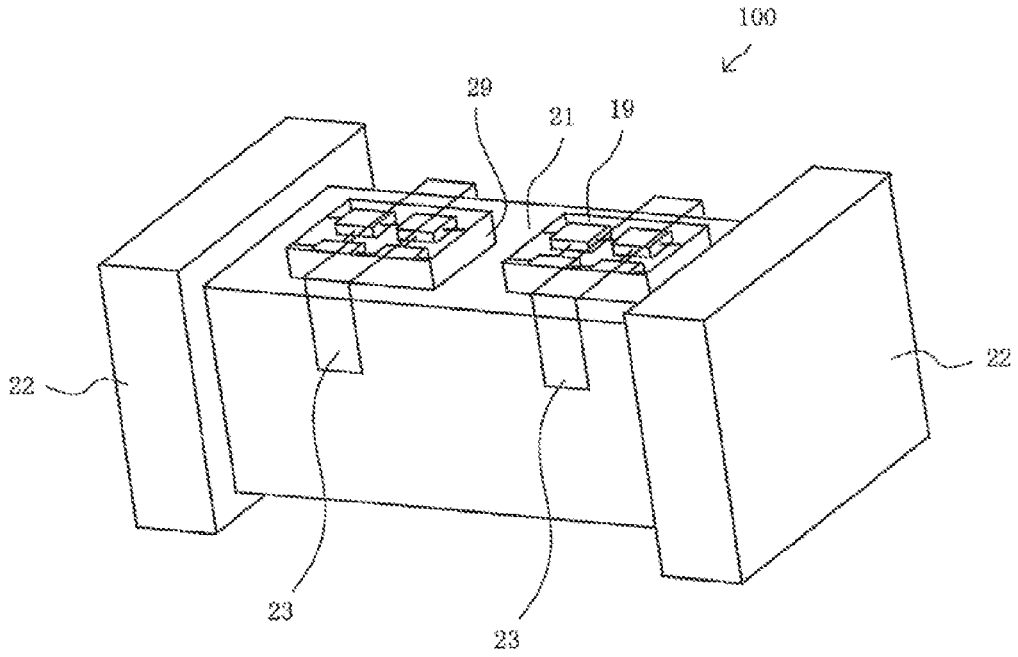
FIG. 13 illustrates the indoor unit illustrated in FIG. 1 when it is packed for transportation.

FIG. 13 illustrates the indoor unit illustrated in FIG. 1 when it is packed for transportation. As illustrated in FIG. 13, when the indoor unit 100 is carried, packing materials 22, covering the sides, top, bottom, front, and rear of the indoor unit 100, are attached to the indoor unit at both the left and right ends thereof. Although not illustrated in the example in FIG. 13, the packing materials 22 are attached to the indoor unit 100 without the lower right-side panel 10, the right bottom panel 11, the lower left-side panel 8, and the left bottom panel 9 being attached to carry the indoor unit 100. The lower right panel kit 19 and a lower left panel kit 29 are then affixed on the indoor unit 100 with, for example, an installation plate 21 interposed therebetween using adhesive tape 23. The installation plate 21 is a plate-like member formed of, for example, metal. The lower right panel kit 19 is attached onto the top of the indoor unit 100 to the right of the lower left panel kit 29, and the lower left panel kit 29 is attached onto the top of the indoor unit 100 to the left of the lower right panel kit 19. The lateral position relation is more understandable when the lower right panel kit 19 is attached on the right side and the lower left panel kit 29 is attached on the left side. However, the position relation is not limited to this, and the kits may be attached on the opposite sides. The indoor unit 100 is then accommodated in a packing box such as a cardboard carton while the unit has the packing materials 22 attached to the left and right ends thereof and the lower right panel kit 19 and the lower left panel kit 29 affixed thereon to be stored and carried. Herein, the height of the frames of the lower right panel kit 19 and the lower left panel kit 29 is lower than that of the packing materials 22. Consequently, the packing materials 22 can protect the lower right panel kit 19 and the lower left panel kit 29 in addition to the indoor unit 100 against the impact from the outside. As described above, according to the indoor unit 100 of this embodiment, the packing materials and the buffers for the lower right panel kit 19 and the lower left panel kit 29 during transportation can be omitted or simplified.

The present invention is not limited to the above-described embodiment, and various modifications are possible within the scope of the invention. That is, the structure of the above-described embodiment may be improved as appropriate, and may be at least partially replaced with another structure. Furthermore, components of which layouts are not specified are not necessarily arranged as in the embodiment disclosed above, and may be arranged at positions allowing the functions thereof to be achieved.

REFERENCE SIGNS LIST

1 rear case 2 lower right corner portion 3 lower left corner portion 4 front case 5 air outlet 6 wind adjusting unit 8 lower left-side panel 8A first lower left-side panel 8B second lower left-side panel 9 left bottom panel 9A first left bottom panel 9B second left bottom panel 10 lower right-side panel 10A first lower right-side panel 10B second lower right-side panel 10-1 coupler portion 10-2 attachment portion 11 right bottom panel 11A first right bottom panel 11B second right bottom panel 11-1 coupler portion 11-2 attachment portion 14 casing 19 lower right panel kit 19*a* first frame 20 void 21 installation plate 22 packing material 23 adhesive tape 29 lower left panel kit 100 indoor unit 190 engaging portion 190*a* first engaging portion 190*b* second engaging portion.

The invention claimed is:

1. An indoor unit for an air-conditioning apparatus, the indoor unit being connectable to an outdoor unit using a pipe, the indoor unit comprising:

a casing having a cuboid shape and constituting an outer frame;

the casing including a rear case, a lower right-side panel constituting a lower portion of a right side of the casing, a right bottom panel constituting a right portion of a bottom of the casing, a lower left-side panel constituting a lower portion of a left side of the casing, and a left bottom panel constituting a left portion of the bottom of the casing;

the lower right-side panel and the right bottom panel being coupled with each other and being attached to the rear case to be a lower right portion of the casing by rotatable coupling of a first adjustable coupler portion formed on the lower right-side panel with a second adjustable coupler portion formed on the right bottom panel;

the lower left-side panel and the left bottom panel being rotatably coupled with each other and being attached to the rear case to be a lower left portion of the casing by rotatable coupling of a third adjustable coupler portion formed on the lower left-side panel with a fourth adjustable coupler portion formed on the left bottom panel;

one or more of the lower right-side panel, the right bottom panel, the lower left-side panel, and the left bottom panel being a panel provided with a void through which the pipe is drawn out or a panel without the void;

wherein, at a face of the casing through which the pipe passes, one or more of the lower right-side panel with the void, the right bottom panel with the void, the lower left-side panel with the void, and the left bottom panel with the void rotatably coupled to the casing at the face; and wherein, at a face of the casing through which the pipe does not pass, one or more of the lower right-side panel without the void, the right bottom panel without the void, the lower right-side panel without the void, and the right bottom panel without the void rotatably coupled to the casing at the face.

2. A kit for an indoor unit of an air-conditioning apparatus, the indoor unit being connectable to an outdoor unit using a pipe, the kit comprising:

a casing assembly having a cuboid shape and constituting an outer frame;

components of the casing assembly including a rear case, a lower right panel kit, and a lower left panel kit, wherein the lower right panel kit includes:

lower right-side panels constituting a lower portion of a right side of the casing, right bottom panels constituting a right portion of a bottom of the casing, and a first frame to which one of the lower right-side panels and one of the right bottom panels are attached;

the lower right-side panels comprising a panel with a void through which the pipe is drawn out and a panel without the void, the right bottom panels comprising a panel with a void through which the pipe is drawn out and a panel without the void;

the lower left panel kit includes:

lower left-side panels constituting a lower portion of a left side of the casing, left bottom panels constituting a left portion of the bottom of the casing, and a second frame to which one of the lower left-side panels and one of the left bottom panels are attached;

the lower left-side panels comprising a panel with a void through which the pipe is drawn out and a panel without the void, the left bottom panels comprising a panel with a void through which the pipe is drawn out and a panel without the void; and the lower right-side panels, the right bottom panels, the lower left-side panels, and the left bottom panels are configured to not be attached to the rear case when packaged.

* * * * *